United States Patent [19]

Havranek et al.

[11] 3,986,371

[45] Oct. 19, 1976

[54] METHOD FOR FORMING LOOPS IN CIRCULAR KNITTING MACHINES

[75] Inventors: Milan Havranek; Ivan Musil, both of Brno, Czechoslovakia

[73] Assignee: Elitex, Zavody textilniho strojirenstvi generalni reditalstvi, Liberec, Czechoslovakia

[22] Filed: June 28, 1974

[21] Appl. No.: 484,470

Related U.S. Application Data

[60] Division of Ser. No. 365,573, May 31, 1973, Pat. No. 3,837,185, which is a continuation-in-part of Ser. No. 105,851, Jan. 12, 1971, abandoned.

[30] Foreign Application Priority Data

Jan. 16, 1970 Czechoslovakia ..... 330-70

[52] U.S. Cl. ..... 66/107; 66/93

[51] Int. Cl.[2] ..... D04B 15/06

[58] Field of Search ..... 66/8, 104, 107, 108 R, 66/93

[56] References Cited

UNITED STATES PATENTS

| | | | |
|---|---|---|---|
| 1,007,494 | 10/1911 | Scott | 66/108 X |
| 1,218,073 | 3/1917 | Franck | 66/107 X |
| 1,539,568 | 5/1925 | Houserman | 66/107 |
| 1,770,469 | 7/1930 | Grieve | 66/107 X |
| 2,069,155 | 1/1937 | Lawson | 66/107 |
| 2,090,500 | 8/1937 | Lawson | 66/107 |

FOREIGN PATENTS OR APPLICATIONS

| | | | |
|---|---|---|---|
| 307,633 | 3/1929 | United Kingdom | 66/107 |
| 7,459 | 1899 | United Kingdom | 66/107 |

*Primary Examiner*—Mervin Stein
*Assistant Examiner*—Andrew M. Falik

[57] ABSTRACT

A method for forming loops on a circular knitting machine having a plurality of needles and sinkers alternately arranged in cooperation with each other. The sinkers are supported on a rotatable ring located exterior of said cylinder, and have a yarn engaging edge extending perpendicular to the needles and a heel at its opposite end. The steps comprising feeding a yarn to the needles, while sequentially moving the needles downwardly within the cylinder to draw the yarn. Simultaneously engaging the sinkers at their heel ends and advancing each of the sinkers toward an associated pair of needles along a straight line direction at an acute angle to the needles synchronously as the needles move downwardly. Thereby the yarn engaging edge is moved vertically upwardly while the edge is maintained perpendicular to said needles. The edge thus engages the yarn and cooperates with the associate needles to form loops from the yarn simultaneously on the associated needles and sinker.

1 Claim, 12 Drawing Figures

Fig-4
PRIOR ART
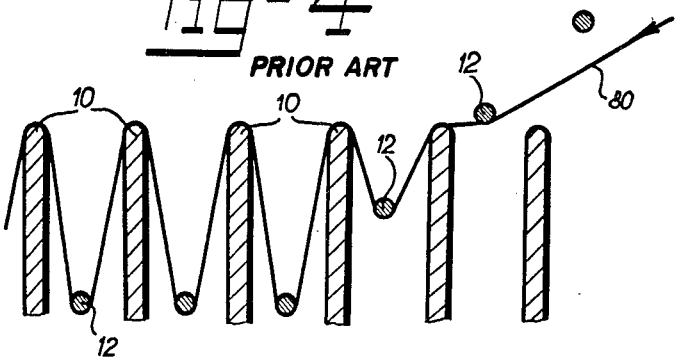
Fig-5
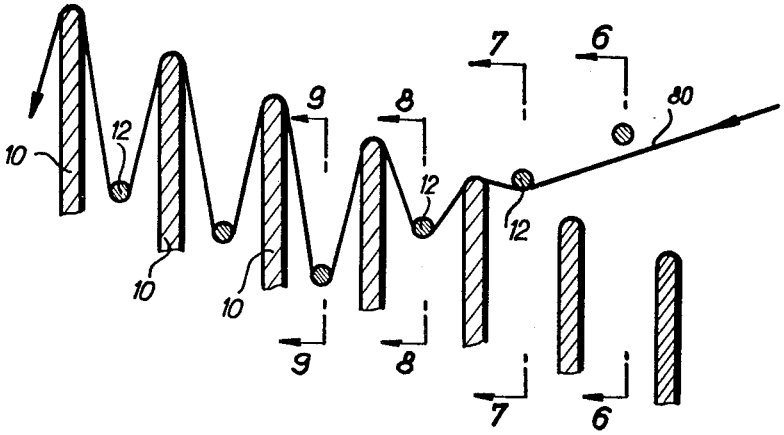
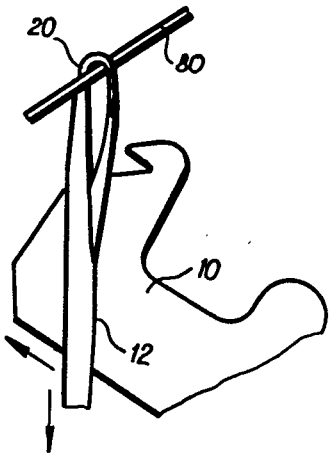
Fig-6
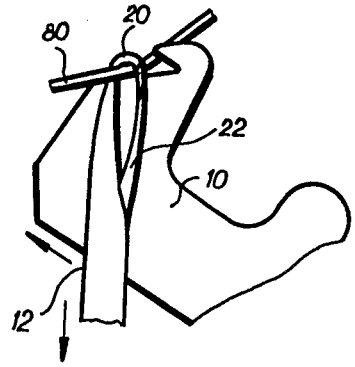
Fig-7
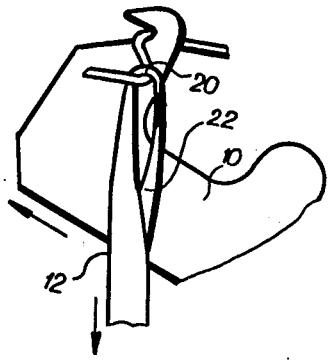
Fig-8

Fig-9
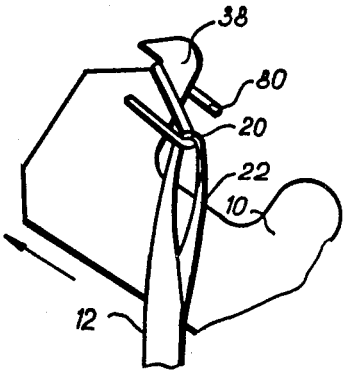
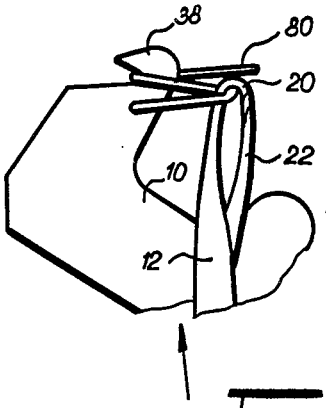
Fig-10
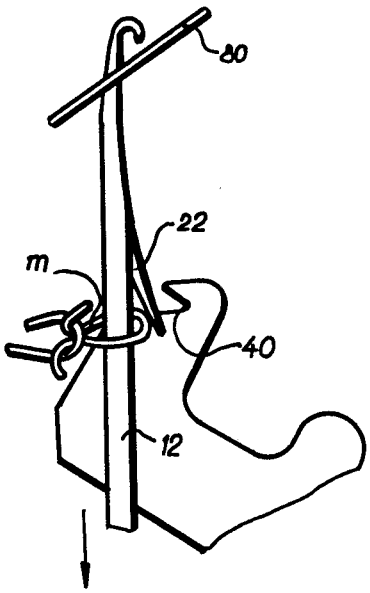
Fig-5a
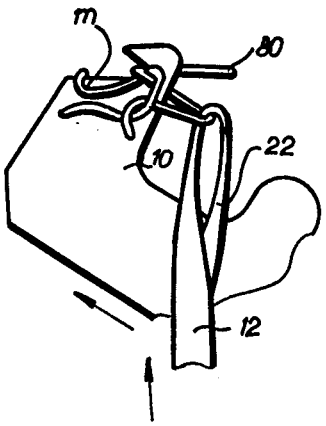
Fig-9a

METHOD FOR FORMING LOOPS IN CIRCULAR KNITTING MACHINES

RELATED APPLICATIONS

The present invention is a division of Ser. No. 365,573, filed May 31, 1973, now U.S. Pat. No. 3,837,185 which in turn was a continuation-in-part of Ser. No. 105,851, filed Jan. 12, 1971, now abandoned, bearing the same title. The disclosure of Ser. No. 105,851 is referred to and incorporated herein as if more fully set forth.

BACKGROUND OF INVENTION

The present invention relates to a method for forming loops in circular knitting machines, and particularly to a system for arranging the needles in cooperation with the sinker so that part of the loop is made by the needles and part is made by the sinker.

Conventional knitting machines employ both needles and sinkers. The sinkers are moved in a horizontal direction and their function is limited to knocking off the knit work or loops from the needle. The forming of loops is performed by drawing yarn on to the needles over the level of the sinkers, the size of the loop being determined by the depth of the drawing of the needles below the loop forming level of the sinkers. The level of the sinkers remain constant with respect to the needle cylinder and with respect to the drawing of the loop.

Since the formation of the loop and its size is solely dependent on the movement of the needle, it is necessary to take great care in controlling the movement of the needle. In operation, the needles are moved synchronously in progression to draw in the yarn and it is therefore necessary to choose the pitch angle of the needle cam so that the progression of movement (i.e., the number of simultaneously drawn in needles) does not surpass a predetermined limit at which due to high friction, the yarn tension would increase to an extent that the yarn is broken. This problem is accentuated when the speed of the machine is increased to high production levels. On the other hand by choosing a high pitch angle for the needle cam, it is possible to increase the working speed of the machine, however, this results in a great deal of mechanical stress and strain on the needles coupled with frequent failure and a large number of broken needles.

It is an object of the present invention to provide a method for operating a circular knitting machine overcoming the disadvantages and disabilities of the prior art devices.

A further object of the present invention is to provide a method for use of a circular knitting machine in which the sinkers are operated in cooperation with the needles to perform the function of not only knocking off the loop but of also forming a part of the loop in cooperation with the needles.

It is a particular object of the present invention to provide a circular knitting machine in which the sinkers are moved in an oblique angle to the path of movement of the needle so that the sinkers need only be reciprocated a relatively small extent.

It is a further object of the present invention to provide a circular knitting machine wherein both the needles and sinkers cooperate to form portions of the same loop thereby enabling the machine to be made with fewer needles.

These objects, others and numerous advantages will be found clearly set forth in the following specification of the present invention.

SUMMARY OF INVENTION

In carrying out the present invention, a knitting machine is employed having a cylinder, wherein a plurality of needles operable in predefined path are located. The machine includes means for feeding yarn to the needle, and is provided with a plurality of sinkers arranged individually between the needles and operable in combination therewith to form the loop partially on the needle and partially on the sinkers.

In the method according to the present invention, the circular knitting machine of the type described is operated so that the yarn is fed to the needle and the needles and the sinkers are thereafter synchronously moved to simultaneously draw a partial loop on the sinkers and to slide the remaining portion of the partial loop downwardly past the latch of the needle, the needle is then moved downwardly to release the partial loop while simultaneously drawing a second portion of the yarn fed to it, the sinker simultaneously retracting so that the partial loop formed thereon is completed.

Complete details of, the method of operation of the present invention is disclosed in full detail herein in combination with the preferred form of the apparatus for carrying out the same. In the disclosure reference is made to the accompanying drawings showing an embodiment of the apparatus.

BRIEF DESCRIPTION OF THE DRAWINGS

In the accompanying drawings:

FIG. 4 is a schematic view of the loop forming method in separate stages under the prior art teachings;

FIG. 5 is a view similar to FIG. 4 showing the loop formation in process according to the present invention;

FIG. 5*a* is a lateral view taken just prior to the point of section 6—6 of FIG. 5 with the previously formed loop resting on the shank of the needle under the open latch;

FIG. 6 is a lateral view taken at the point of section 6—6 of FIG. 5;

FIG. 7 is a lateral view taken at the point of section 7—7 of FIG. 5;

FIG. 8 is a lateral view taken at the point of section 8—8 of FIG. 5;

FIG. 9 is a lateral view taken at the point of section 9—9 of FIG. 5;

FIG. 9*a* is a lateral view taken just after the point of section 9—9 of FIG. 5 showing the needle starting to move in the opposite direction after it has reached its lowermost position as shown in FIG. 9; and FIG. 10 shows relative positions of a needle and a sinker after a loop has been formed, when the sinker is in its top dead center and holds the already formed loop whereas the needle moves upwards.

In all figures, the instantaneous movements of both the needles and sinkers are indicated by means of arrows.

Figure 1:
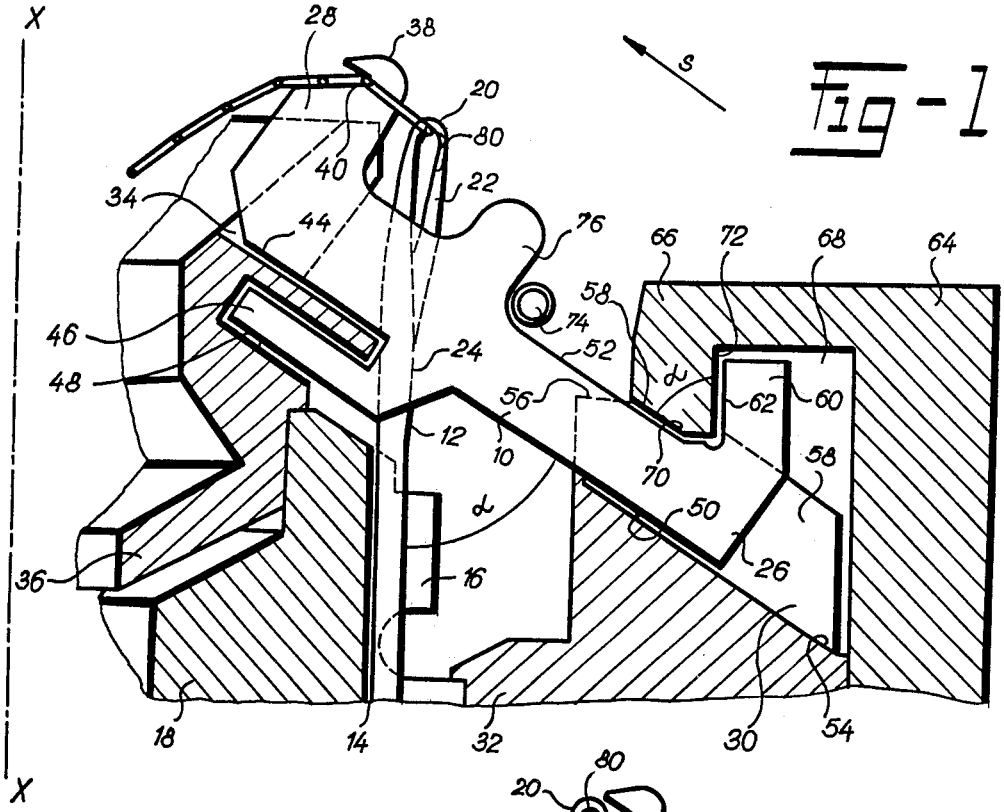
FIG. 1 is a sectional view through a sector of a circular needle cylinder showing a needle, a cooperating sinker, the sinker circle and the sinker cam.

The drawings are schematic in form and show only those portions of a circular knitting machine which are essential for the understanding of the present invention. It will be noted that FIG. 1 is a perpendicular view of a circular knitting machine parallel to the axis of rotation thereof and shows only one sector of the machine. Various auxiliary mechanisms such as: yarn feeding devices, work withdrawing means, cylinder and cam devices, and numerous other auxiliary devices are omitted in order to maintain the present disclosure as brief and concise as possible and in order to eliminate extraneous description since these devices are well known to those skilled in the present art. The circular knitting machine in general is constructed and operates in the well known and conventional manner and those mechanisms omitted from the present disclosure may be substituted therein in the usual form in which they are found. Should, for any reason, a disclosure be necessary for this conventional mechanism, reference can be made to U.S. Pat. No. 1,152,850 and to Principles of Knitting, Vol. II (Circular Knitting), William E. Shinn, Clark Publishing Co., Charlotte, N.C., 1949.

DESCRIPTION OF THE INVENTION

Figure 2:
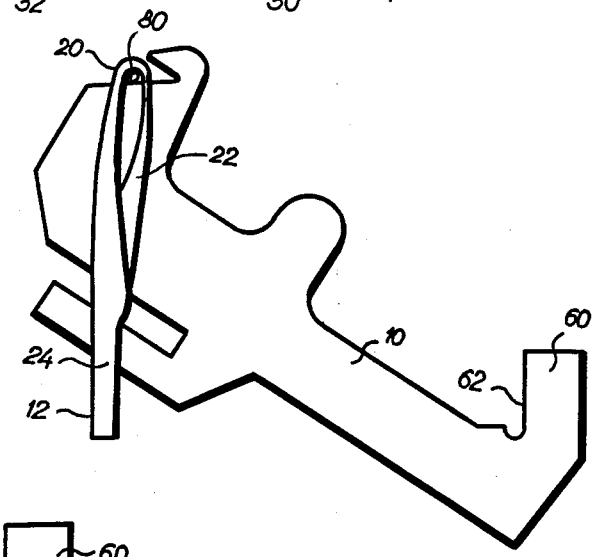
FIG. 2 is a schematic view of the needle and sinker shown in FIG. 1 showing the beginning of the loop forming motion.
Figure 3:
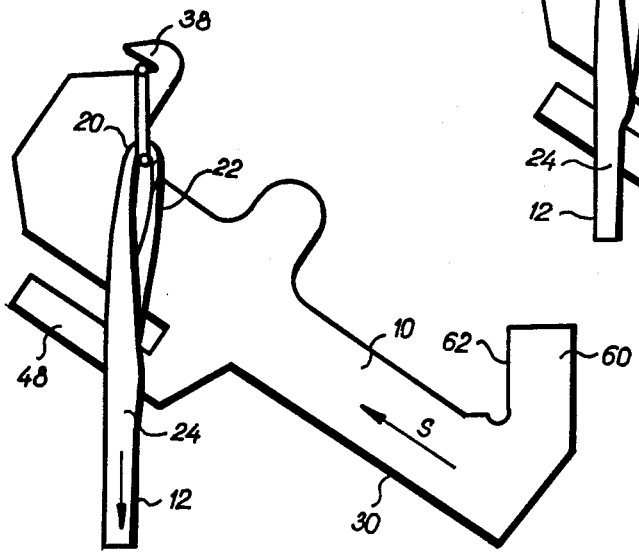
FIG. 3 is a view similar to FIG. 2 showing the position of the needle and sinker after finishing the loop forming motion.

With the conventional operation of the circular knitting machine in mind, reference can now be made to FIGS. 1–3 wherein the particular construction and arrangement of the sinkers and needles for carrying out the present invention is depicted. The annularity of the knitting machine and the fact that a plurality of needles and sinkers are intended will be obvious from FIG. 1 although only one set of needles and sinkers are shown.

Each loop forming sinker 10 is associated with a needle 12 which itself is retained in conventional manner within a vertical bed 14 formed by the inwardly extending ribs 16 of a conventional needle cylinder 18. The needle cylinder 18 rotates about a vertical axis X—X by the provision of suitable rotating means. Conventional cams, jacks, yarn-feeding devices, etc., are also provided although, as noted, not shown. Each needle 12 has a hook 20, a latch 22 and a vertical shank 24. Each sinker 10 has an elongated linear body terminating in a heel-end 26 and a head-end 28. The heel 26 is slideably located within an oblique slot 30 formed on the upper edge of a sinker cam ring 32 located within the cylinder 18 while the head end 28 rides in a similarly formed slot 34 aligned along the same oblique path. The slot 34 is formed on the upper edge of a sinker circle or annulus 36.

The head-end of the sinker 10 includes a conventional hook neb 38 and a throat 40 from which extends a yarn engaging edge or surface substantially perpendicular to the direction of movement of the needle 12 or to the axis of rotation on which yarn 42 may be drawn into a loop. The lower edge 44 of the head is straight and rests on the bottom of the slot 34. Located below this edge 44 is an extending finger 46 arranged parallel therewith and integrally formed with the sinker 10. The finger 46 extends within a groove 48 formed within the inner face of the sinker circle 36. The finger 46 acts to maintain the sinker in its proper position during movement.

The heel 26 of the sinker 10 likewise has a lower edge 50 and a parallel upper edge 52. The slot 30 in which the heel 26 rides has a bottom 54 on which the lower edge 50 is adapted to slide. The open upper edge 56 of the cam 32 is cut in stepped fashion to provide a central portion 58 inclined parallel to the bottom 54 of the slot 30, but spaced from it, a distance equal only to the distance between the lower and upper edges 50 and 52 of the sinker 10. Thus the upper edge 52 of the sinker and the edge 58 of the slot 30 are substantially co-planar. The heel 26 terminates in an upwardly extending finger 60 which has an inner vertical edge 62 parallel to the axis X—X of the machine.

Placed above the sinker cam ring 32 is a cover member 64 having a depending annular skirt 66 forming an inverted groove 68 located over the upwardly extending heel finger 60. The skirt 66 has an oblique surface 70 adapted to rest upon the upper edge 56 of the sinker cam ring 32 to thus form an abutting sliding surface for the upper edge 52 of the sinker. The depending skirt 66 has an inner surface 72 which is contoured to form an abutting sliding cam surface for the vertical edge 62 of the finger 60. An annular coil spring 74 abuts against a projection 76 extending upwards from the sinker about midway between its length. The coil spring 74 normally urges the sinker 10 so as to maintain the surface 62 of the finger 60 abutting against the cam surface 72 of the annular depending cover skirt 66. The surface 72 of the depending skirt is of course, annular and is provided with a predetermined contour so that the sinker can be reciprocated in the respective slots 30 and 34 on engagement along the surface of the cam in a timed relationship with the needles on the needle cylinder.

The lower edge 50 and the upper edge 52 of the sinker 10 are parallel in an angle oblique to the vertical or perpendicular axis, defined generally by the axis of the machine X—X, the surfaces 70 of the depending skirt 66 and the direction of movement of the needle 12. Similarly, the bottoms of both slots 34 and of the groove 48 are parallel to this same oblique angle. These parallel oblique edges and surfaces make an angle alpha $\alpha$ which is consequently the same between the shank 24 and the lower surface 50 of the sinker as between the vertical cam face 72 and the upper surface 52 of the sinker. While the angle alpha is preferably acute, it may be chosen at approximately 45°. The sinker is thus arranged to move in an acute angular path relative to the path of the needle, causing the sinker neb 38 to move in a similar direction with respect to the hook of the needle but nevertheless maintaining the yarn engaging surface of the throat 40 perpendicular to the path of movement of the needle. The sinkers, grooves, slots, etc., are arranged and dimensioned to permit the sinker to reciprocate in timed sequence in this angular direction with a sliding fit and to avoid excess play, wobble or movement between it and the guide slots. It will be appreciated that each of the sinkers are mounted in exactly the same manner and relative to each other radially about the axis X—X and will be progressively operated in cooperation with the progressive movement of the needles by the sinker cam.

As illustrated in FIGS. 5 through 10, the operation of both the needles and the sinkers during loop formation is as follows:

In their starting position, each of the needles 12 is in its uppermost position with respect to the needle cylinder, this position not being shown. Consequently, in FIG. 5 the needle in its starting position would be to the right of section 6—6. Each needle 12 is disposed between two adjacent sinkers, each of which are numbered 10, as indicated hereinbefore.

Formation of a new loop of the knit fabric is started by feeding yarn 80 under the hook 20 of the needle 12, as can be clearly seen in FIG. 5*a* which also shows the previously formed loop *m* which rests on the shank of the needle 12, under the open latch 22, and the sinker 10 is in its lower position, that is, of its greatest distance away from the axis of the needle cylinder and still at a standstill. Only needle 12 moves downwards, as indicated by an arrow in FIG. 5*a*. When the first section of continuous yarn 80 is drawn to the needle and sinker and while the previous knitted loop or partial loop is disposed on the hook 20 of the needle, the latch may then be closed or left open. The sinker and needle are synchronously moved (the sinker moved in the direction of the arrow S in FIG. 1) until the yarn 80 is caught in the throat 40 of the sinker and the previous loop *m* hung on the needle is pulled on the sinker and on the needle, as explained more fully hereinafter.

The next phase of loop formation is shown in FIG. 6. The needle 12 continues its downward movement (in the direction of the arrow), whereas the sinker 10 already begins to move in the direction of the respective arrow towards the axis of the cylinder, that is, in an oblique, upward direction, so that the previously formed loop resting on the clearing plane, that is, on the perpendicular yarn engaging surface of the sinker, closes the hook 22 of the needle 12 whereby the yarn 80 is confined within the hook 20 of the needle 12.

As can be seen in FIG. 7, the needle 12 continues its downward movement and the sinker 10 continues its movement in the oblique, upward direction maintaining the yarn engaging surface normal to the needle. The needle 12 starts to draw the yarn 80 through the previously formed loop *m*. The yarn 80 drawn through the previously formed loop and clearing of the new loop can be seen in FIG. 8. At this stage of loop formation, the needle 12 still moves downwards and the sinker 10 obliquely upwards.

FIG. 9 illustrates a stage of operation at which the needle 12 has reached its lowermost position. From this point on, the needle 12 starts to move in the opposite direction, as can be seen in FIG. 9*a*. The sinker 10, however, continues to move in the oblique, upward direction and finishes the loop. The movement of the sinkers in the oblique upward direction is continued as far as the position shown in FIG. 10. On reaching the position according to FIG. 10, the movement of the sinker 10 is stopped, whereas the needle 12 continues in its upward movement, so that the newly formed loop opens the latch 22 of the needle 12 and the loop falls over the latch 22 onto the shank of the needle, after which the needle is ready to receive a new yarn. In this connection, it is pointed out that during the transfer of the loop from the hook onto the shank 24 of the needle 12, the knit fabric is held on the perpendicular yarn engaging surface by the hook neb 38 of the sinker 10. At the time at which the needle 12 reaches its uppermost directional position, the sinker 10 which has finished its oblique upward movement is displaced in an oblique downward direction, back into its initial position according to FIG. 5*a*. Moreover, as the needle and sinker finish their respective upward and downward movements, the loop *m* slides down the shank 24 of the needle and past the opening latch 22. However, during this time the yarn 80 is prevented from moving up the needle.

As soon as the loop moves over the open latch 2 onto the shank 24 of the needle, the needle 12 reverses its direction and begins to move downwardly. Simultaneously the sinker 10 advances upwardly along the path of to the arrow S. During the downward movement of the needle and before the latch 22 is closed, a new section of the yarn 80 is deposited in the hook 20 of the needle. Consequently, as the sinker 10 advances upwardly and the needle 12 moves downwardly the loop is carried over the second section of the yarn and is completed and formed. The needle 12 continues falling and in cooperation with the sinker 10, creates the new loop. Thus, when the next course is knitted, the entire cycle of loop formation is repeated.

The formation of the loop is created by the vertical motion of the needle in cooperation with the yarn engaging edge, which is maintained perpendicular to the needle throughout the oblique motion of the sinker in both the extended and retracted directions. The extended movement of both needle and sinker therefore, need only be relatively small with respect to each other, since only a short distance is needed for the sinker to both knock off the yarn from the needle and to create the partial loop. The relatively small movements of the needle and sinker when combined, create the sufficiently long loop required. Consequently, both needle and sinker may be reciprocated at a rapid pace and the circular machine may be operated at increased speeds since the shorter stroke permits high speeds while reducing the possibility of breakage of needle or sinker. Furthermore, since the needle and a sinker cooperate to form the loop, it is unnecessary for multiple needles to be used to create the extended loop formation or intermediate partial loops necessary to form a completed loop.

It will thus be seen that the various objects and advantages enumerated earlier are obtained by the present apparatus and by the system and method through which the loops are formed. Various modifications may be made to the system depending upon the nature of the loop and yarn used, the extent of reciprocation and the extent of the angular displacement and arrangement of the sinker with respect to the needle may also be varied for a given circumstance. Of course, the exact structure of the sinker and its, for example, head, its heel portions as well as the actual arrangement of the heel with the cam may also be modified. Since many modifications may be made as noted, it is intended that the present disclosure be illustrative only and not limiting of the invention.

What is claimed:

1. A method for forming loops on a circular knitting machine having a plurality of needles arranged in a needle cylinder for movement parallel to the axis of rotation thereof and a plurality of sinkers, said needles and sinkers being alternately arranged in cooperation with each other, said sinkers being supported on a rotatable ring located exterior of said cylinder, each sinker having a yarn engaging edge extending perpendicular to said needles and a heel at its opposite end, comprising the steps of feeding a yarn to said needles, sequentially moving said needles downwardly within said cylinder to draw said yarn, engaging said sinkers at their heel end and advancing each of said sinkers toward an associated pair of needles along a straight line direction at an an angle of approximately 45° to said needles synchronously as said needles move downwardly to move said yarn engaging edge vertically upwardly while maintaining said edge perpendicular to said needles so that said edge engages said yarn and cooperates with the associate needles to form loops from said yarn simultaneously on said associated needles and sinker.

* * * * *